US009764573B2

(12) United States Patent
Pitz et al.

(10) Patent No.: US 9,764,573 B2
(45) Date of Patent: Sep. 19, 2017

(54) METHODS FOR PRINTING A CURVED SURFACE OF AN OBJECT BY USING AN INKJET HEAD

(71) Applicant: HEIDELBERGER DRUCKMASCHINEN AG, Heidelberg (DE)

(72) Inventors: Heiner Pitz, Weinheim (DE); Matthias Schloerholz, Plankstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/832,341

(22) Filed: Aug. 21, 2015

(65) Prior Publication Data

US 2016/0052312 A1 Feb. 25, 2016

(30) Foreign Application Priority Data

Aug. 21, 2014 (DE) ..... 10 2014 012 395

(51) Int. Cl.
*B41J 25/00* (2006.01)
*B41J 3/407* (2006.01)

(52) U.S. Cl.
CPC ..... *B41J 25/001* (2013.01); *B41J 3/4073* (2013.01); *B41J 25/003* (2013.01); *B41J 25/005* (2013.01)

(58) Field of Classification Search
CPC ..... B41J 25/001; B41J 3/4073; B41J 25/005; B41J 25/003; B41J 3/0436; B41J 3/0442; B41J 3/0447; B41J 3/0463; B41J 3/286; B41J 3/4078; Y10S 901/41; Y10S 901/43; G05B 2219/45065; G05B 2219/45013; B25J 11/0075; B29C 67/0055; B29C 67/0059; B29C 67/0062
See application file for complete search history.

(56) References Cited

U.S. PATENT DOCUMENTS 3,561,398 A * 2/1971 Rose ..... B05B 12/122 118/323
5,144,330 A 9/1992 Bennett
5,521,477 A * 5/1996 Sasaki ..... B05B 12/00 318/567
6,143,122 A * 11/2000 Mossbeck ..... A47C 27/064 156/291

(Continued)

FOREIGN PATENT DOCUMENTS

DE 10323412 A1 12/2004
DE 102009004877 A1 7/2010

(Continued)

*Primary Examiner* — Matthew Luu
*Assistant Examiner* — Patrick King
(74) *Attorney, Agent, or Firm* — Laurence A. Greenberg; Werner H. Stemer; Ralph E. Locher

(57) ABSTRACT

A method for printing at least one section of a flat or preferably curved surface of an object includes using a relative movement between an inkjet head and the object to move the inkjet head along a first path and print a first track in the process and to move the inkjet head along a second path and print a second track in the process. A first track edge of the first track and a second track edge of the second track meet at a point and enclose an angle between about 1° and about 179° at the point. The method permits the curved surface to be printed without perceptible track connections.

18 Claims, 2 Drawing Sheets

(56) References Cited

U.S. PATENT DOCUMENTS

| | | | | |
|---|---|---|---|---|
| 6,176,961 | B1 * | 1/2001 | Mossbeck | A47C 27/064 156/291 |
| 6,345,879 | B1 | 2/2002 | Fisher | |
| 9,086,271 | B2 * | 7/2015 | Melikian | G01B 11/14 |
| 9,452,616 | B1 * | 9/2016 | Mathis | B41J 3/4073 |
| 9,533,506 | B2 * | 1/2017 | Kraus | B41J 2/16552 |
| 9,636,928 | B2 * | 5/2017 | Noell | B41J 11/002 |
| 2002/0134257 | A1 | 9/2002 | Stephenson | |
| 2009/0074979 | A1 * | 3/2009 | Krogedal | G05B 19/404 427/427.2 |
| 2013/0215196 | A1 * | 8/2013 | Lewartowski | B41J 25/001 347/37 |
| 2013/0257984 | A1 | 10/2013 | Beier et al. | |
| 2014/0028748 | A1 * | 1/2014 | Hudd | B41J 2/15 347/12 |
| 2014/0132673 | A1 | 5/2014 | Lewartowski et al. | |
| 2015/0029262 | A1 * | 1/2015 | Weingartner | B41J 25/001 347/37 |
| 2015/0042716 | A1 | 2/2015 | Beier et al. | |
| 2015/0062244 | A1 | 3/2015 | Noell | |
| 2015/0085046 | A1 | 3/2015 | Moehringer et al. | |
| 2015/0138275 | A1 | 5/2015 | Noell | |
| 2015/0273864 | A1 | 10/2015 | Moehringer et al. | |

FOREIGN PATENT DOCUMENTS

| | | | | |
|---|---|---|---|---|
| DE | EP 2208541 | A2 * | 7/2010 | B05B 1/169 |
| DE | 102010004496 | A1 * | 7/2011 | B05B 12/124 |
| DE | 102012006371 | A1 | 7/2012 | |
| DE | 102012006370 | A1 | 10/2013 | |
| DE | 102013016006 | A1 | 4/2015 | |
| WO | 2014060005 | A1 | 4/2014 | |

* cited by examiner

METHODS FOR PRINTING A CURVED SURFACE OF AN OBJECT BY USING AN INKJET HEAD

CROSS-REFERENCE TO RELATED APPLICATION

This application claims the priority, under 35 U.S.C. §119, of German patent Application DE 10 2014 012 395.2, filed Aug. 21, 2014; the prior application is herewith incorporated by reference in its entirety.

BACKGROUND OF THE INVENTION

Field of the Invention

The present invention relates to a method for printing at least one section of a surface of an object, which includes carrying out a relative movement between an inkjet head and the object to move the inkjet head along a first path and print a first track in the process and to move the inkjet head along a second path and print a second track in the process. Furthermore, the present invention relates to a method for printing at least one section of a surface of an object, which includes moving an inkjet head along a first path and printing a first track in the process and moving the inkjet head along a second path and printing a second track in the process.

The invention lies in the technical area of inkjet printing, in particular the printing of substrates that are not flat but curved. "Curved" means that the surface has convex and/or concave sections, etc., such as body parts of vehicles.

The known prior art in this technical area includes the following:

German Patent Application DE 10 2012 006 371 A1, corresponding to U.S. Patent Application Publication No. 2015/0042716, has already disclosed a method and a device which permit the printing of curved surfaces and the drying of the print. In that case, an inkjet head and a dryer are guided along the object or vice versa by using a robot in the otherwise homogenous printed image. German Patent Applications DE 10 2013 016 006, corresponding to U.S. Patent Application Publication No. 2015/0085046 and DE 10 2014 004 507, corresponding to U.S. patent application Ser. No. 14/670,698, disclose methods and a device which, in particular, permit spherical objects to be printed, in which the respective object is moved.

German Patent Application DE 10 2013 014 444, corresponding to U.S. patent application Ser. No. 14/474,460, discloses a method which permits the planning of paths for the printing and drying of curved surfaces and the guidance of the print head/the dryer on the planned paths.

German Patent Application DE 10 2012 006 370 A1, corresponding to U.S. Pat. No. 8,882,242, and German Patent Application DE 10 2013 019 359, corresponding to U.S. patent application Ser. No. 14/547,365, disclose methods and devices which, during the printing of curved surfaces, permit the planning or execution of a plurality of parallel paths in such a way that perceivable defects in the lateral connection of the printed ink tracks are avoided.

If the print must be dried, it may be necessary to print short tracks, in order to be able to dry the same without any disruptive time delay. However, a multiplicity of short tracks also produces a multiplicity of connections of the tracks to one another. As a result, the probability of perceptible defects in the connection can also rise.

In addition, it is known that the human eye perceives long lines extending rectilinearly more easily than short ones extending in curves.

SUMMARY OF THE INVENTION

It is accordingly an object of the invention to provide methods for printing a curved surface of an object by using an inkjet head, which overcome the hereinafore-mentioned disadvantages of the heretofore-known methods of this general type and which make it possible to produce at least two printed inkjet tracks, in which a connection to each other is not perceivable by the naked eye and which therefore has no defects.

With the foregoing and other objects in view there is provided, in accordance with the invention, a method for printing at least one section of a flat or preferably curved surface of an object, which comprises, due to a relative movement between the inkjet head and the object, moving the inkjet head along a first path and printing a first track in the process, and moving the inkjet head along a second path and printing a second track in the process. A first track edge of the first track and a second track edge of the second track meet at a point and, at the point, enclose an angle between about 1° and about 179°, preferably between about 5° and about 175°.

According to the invention, the angle between the track edges is not 0° and not 180° either, i.e. the two printed tracks do not extend parallel to each other. The angle is preferably not 90° either and not in the range between about 85° and 95°, i.e. the two printed tracks do not extend at right angles to each other either. The method according to the invention therefore makes it advantageously possible to produce two printed inkjet tracks, in which the connection to each other is not perceivable with the naked eye and therefore has no defects.

The angle $\alpha$ can preferably be chosen in such a way that $\alpha = \arctan(n*b/m*I)$, with $\alpha \neq 90°$. In this case, b=the distance between two adjacent nozzles of a print head, I=the distance between two successive printed dots in the direction of movement of the print head, and n, m=natural numbers. As a result, it is ensured that the respective last printed dot of a row of printed dots of a second track is at the same distance from the printed dots of the first track that adjoin the second track, so that a homogenous transition region between the two tracks is produced.

If the image to be printed and assembled from the tracks is screened, it may be advantageous to choose the screen angle within two tracks in such a way that that screen angle is coordinated with the angle between the track edges of the two tracks and additionally reduces the occurrence of perceivable connections of the tracks to one another.

The tracks can extend approximately rectilinearly along the curved surface. However, they can also have curves. The width of the tracks can be substantially constant. However, the width can also change, e.g. the width can decrease as a result of rotation of the print head or as a result of nozzles at the edge of the head being switched off.

It may also be advantageous, as early as during the generation of the printing data (in the so-called RIP), to take into account the angle between track edges and possible overlap areas that is used during the path planning. Preferably, this is done in such a way that each image point is printed only once, even in the event of the print head travelling over repeatedly. Printed dots in the respective area of the connection between two tracks are preferably assigned to one of the two tracks in the RIP.

The track edges can preferably be printed in a tapering manner and dovetail with adjacent track edges (which is known as stitching).

The inventive method described can advantageously lead to a deficient mechatronic precision of a robot-guided inkjet head having an effect that is imperceptible or perceivable only to a low extent, since defective lines, i.e. relatively long parallel printed gaps with a reduced optical density or print intersections with an increased optical density, are avoided. Such lines are perceived substantially more sensitively by the human eye than mutually angled deviations of the printed dots from a predefined ideal grid.

Since an articulated-arm robot (provided as a movement unit for the print head) moves through the theoretically achievable space on predefined paths, so-called singularities occur. In practice, it is not possible for the robot to pass through these singularities. As a result, it would not be possible for individual planned tracks to be printed and the practically usable space of the robot would be restricted. However, singularities can be avoided if the path which leads through this point of the singularity can be changed. According to the invention, a robot which moves the print head is able to vary the printing paths, at least in the image plane, since the paths no longer necessarily have to be located in parallel. In this way, the number of singularities is reduced and the space in which the robot can print is enlarged. Expressed in another way, as a result of the non-parallel path guidance, larger objects can be printed with the same robot than in the case of parallel path guidance.

In accordance with another preferred mode of the invention, the angle lies between about 20° and about 70° or between about 110° and about 160°, preferably at around 45° or at around 135°.

In accordance with a further preferred mode of the invention, the first path and the second path overlap in an overlap area.

In accordance with an added preferred mode of the invention, in at least one part of the overlap area, the inkjet head prints only on the first path or on the second path, in particular in the whole of the overlap area the inkjet head prints on the first path and does not print on the second path.

In accordance with an additional preferred mode of the invention, the second path crosses the first path in the overlap area. In the overlap area, the image area to be printed can be produced during the printing of one track. Alternatively, two or more tracks can be produced in the image area during printing. In the case of two tracks, each track can contribute about half of the image points in the image area; in the case of three tracks, each can contribute about one third.

In accordance with yet another preferred mode of the invention, the second path and the first path cross in a plurality of overlap areas.

In accordance with yet a further preferred mode of the invention, the section is assembled substantially from overlap areas.

In accordance with yet an added preferred mode of the invention, the inkjet head changes its orientation relative to the respective path on the first path and/or on the second path.

With the objects of the invention in view, there is also provided a method for printing at least one section of a flat or preferably curved surface of an object, which comprises moving an inkjet head along a first path and printing a first track in the process, and moving the inkjet head along a second path and printing a second track in the process. The inkjet head changes its orientation relative to the respective path on the first path and/or on the second path. This process can be designated as a "tilted pass."

In accordance with a concomitant mode of the invention, during its forward movement on the first path and/or on the second path, the inkjet head is rotated about an axis, in particular about an axis perpendicular to the area of the first track and/or second track.

In the case of a simple tilted pass, the angle of the print head relative to the printing direction is changed. As a result, the maximum printing width of the print head changes, but the printed dot density of the track to be printed is kept constant by compensating for the printing spacings of the individual rows of printed dots. A multiple tilted pass is also possible. In this case, at least one overlap area is produced, the printed image of which is assembled from image points of a plurality of tracks.

In the case of a dynamic tilted pass, the track to be printed, in particular at the track start or track end (end connection), can become narrower during the printing of a track and can even end in one (printed) point. The boundary or the track edge can be curved. The adjacent track can likewise begin narrowed (or at the point in the extreme case), so that the connection between two tracks can be reduced to a point. As a result, tracks which (to some extent) have no boundaries extending in parallel are produced. The lateral connection is preferably realized by a track having a likewise curved boundary.

Instead of a preferably curved surface, a flat or even surface can also be printed by the method according to the invention. In this case, provision can preferably be made for the paths and associated tracks or track edges to have angles of about 120° to one another. Such printing can be designated as "hexagonal printing" because of the triangular or hexagonal structures overall that are produced. Such flat substrates can preferably be substrates which are located in an upright orientation, e.g. billboards or other advertising surfaces, flat sections of building facades or room walls, flat sections of side walls of vehicles (trucks, trailers, containers, trains, wagons), traffic and information signs.

Provision can further be made to store the calculated printed dots from a first path plan instead of printing them as a mosaic. These data serve as information for a second path plan, with the second path plan differing from the first path plan, i.e. having different path courses. The actual printing is carried out in accordance with this second path plan as a mosaic. This method is intended to reduce moiré-type effects, for example. (Edge) printed dots, of which only some proportions lie on one path of the second path plan, are printed in a corresponding proportional size or as a gray value. The tracks of the second mosaic can optionally be created with an obliquely placed printing head. The rows of printed dots of these tracks are then closer to one another; the maximum printed dot density becomes correspondingly higher. As a result, the theoretical printed dots of the first mosaic can be depicted better or more accurately.

The printed image to be produced overall can be assembled in the manner of a mosaic from the tracks; any desired track shapes can be printed. Care is taken in this case that the track shapes fill the printed image in the manner of repeating or non-repeating tiling.

The invention can be applied not only when printing one color but also in multiple printing, e.g. in CMYK printing. In this case, each color separation can be treated separately according to the invention, and the method according to the invention and the developments thereof as well as the corresponding path plans can be carried out separately for each color. It is of particular advantage if the track edges of two or more colors that are different from one another are not located on one another or in parallel beside one another but, according to the invention, enclose an angle that is different from 0° and 180°. An appropriate method can proceed as follows. Firstly, a first color is printed onto the object, with the track edges of the first color enclosing angles between about 1° and about 179° with each other, preferably between about 5° and about 175°. The first color is then pinned, i.e. dried but not dried completely, or partly cured. A second color is then printed on, with an angle between about 1° and about 179° to each other, preferably between about 5° and about 175°, likewise being observed. The track edges of the second color are oriented in such a way that they have the aforementioned angle not only to one another but also to the track edges of the first color. This is continued in a corresponding way for further colors, always taking care that all of the track edges have the aforementioned angle relationships to one another. Each color is pinned, possibly with the exception of the last color. Finally, all of the colors printed on are jointly dried completely or thoroughly cured.

An alternative mechanical method during multicolor printing can provide for the print heads of the individual colors to be disposed with the aforementioned angular relationship to one another, e.g. mounted on a robot arm. In this case, a single path plan would be sufficient for all colors, since, during the movement of the robot, the heads have mutually different (fixed) angular relationships and accordingly print "angled" tracks.

Other features which are considered as characteristic for the invention are set forth in the appended claims.

Although the invention is illustrated and described herein as embodied in methods for printing a curved surface of an object by using an inkjet head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of two preferred exemplary embodiments when read in connection with the accompanying drawings.

DETAILED DESCRIPTION OF THE INVENTION

Figure 1:
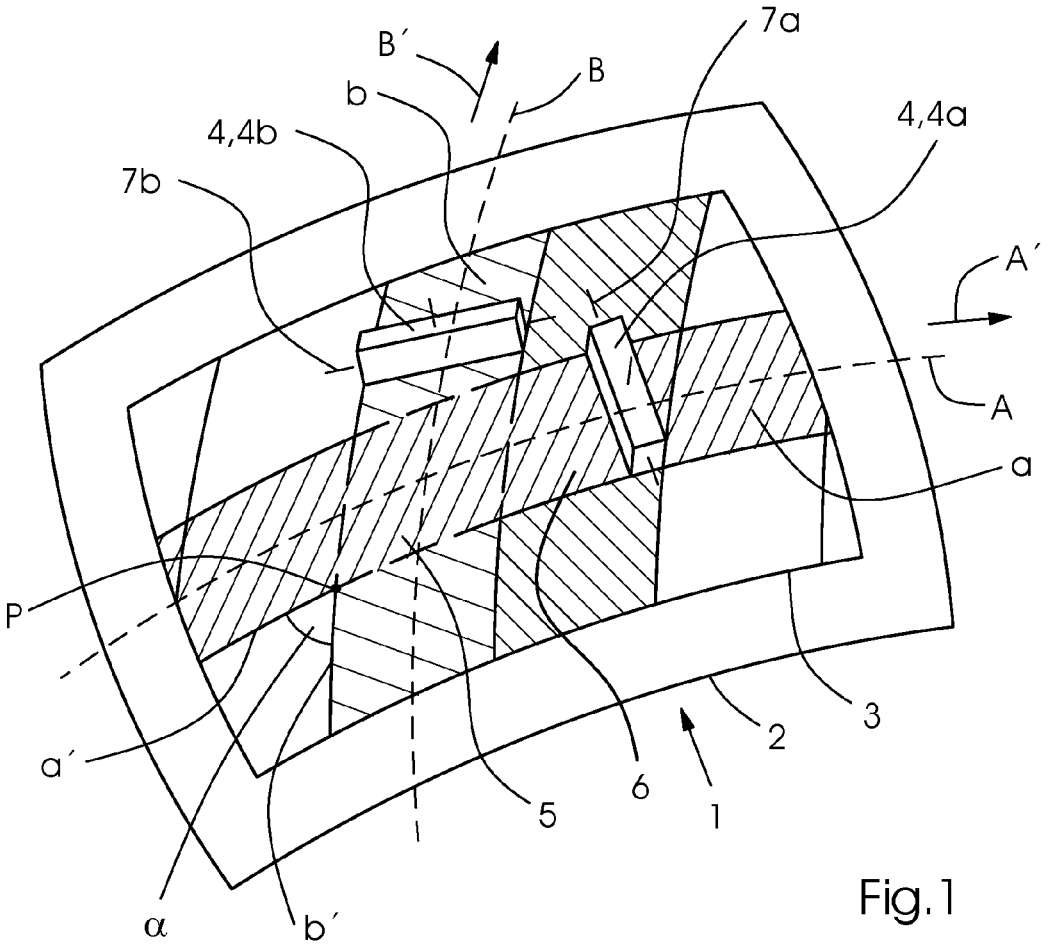
FIG. 1 is a diagrammatic, perspective view of a device during the performance of a preferred embodiment of the method according to the invention.

Referring now in detail to the figures of the drawings, in which mutually corresponding elements are provided with the same designations, and first, particularly, to FIG. 1 thereof, there is seen a diagrammatic, perspective illustration of a device during the performance of a preferred embodiment of the method according to the invention.

An object 1 having a curved surface 2 is shown. The surface is preferably curved in two spatial directions. A section 3 can be seen on the surface. This section is intended to be printed. An inkjet head 4 is provided for the printing. The head is shown in two positions, once as head 4*a* and once as head 4*b*. The head is moved along a first path A in a first direction A'. The path A (and also a path B described below) is curved in accordance with the surface and is at a distance from the surface so that high-quality printing is possible and a collision between the head and the surface is prevented. During the movement along the first path, the head prints a first track a on the surface. The first track a (and also a track b described below) is formed of ink or ink droplets, which the head expels by using nozzles of a row of nozzles. The expulsion is carried out under control and takes into account both the onward movement of the head and also the printing image to be printed. The printing image can be a solid area or a grid. It can also include, for example, text, image or pattern.

The inkjet head 4 is also moved along a second path B in a second direction B'. The movements along both paths are preferably carried out by using an articulated-arm robot, linear robot or a combined robot with rotating and sliding joints. The movements along the two paths can be made by moving the inkjet head or by moving the object or by a combination of the two movements. During the movement along the second path, the head prints a second track b on the surface 2.

In FIG. 1, a first track edge a' of the first track and a second track edge b' of the second track are shown. These track edges meet at a point P and enclose an angle $\alpha$, where $\alpha$ is greater than 0° and less than 180°, i.e. the two tracks do not extend in parallel. In the example shown, the angle $\alpha$ is about 45°.

In FIG. 1, it can be seen that the two paths A and B overlap in an overlap area 5. In the example shown, the two paths cross. However, it is also possible that the second path B merely butts up against the first path A but is not continued on the opposite side of the first path. The inkjet head 4 preferably prints only on one of the two paths in the overlap area. In the example shown, the head prints only on the first path in the overlap area. The first track a is therefore an uninterrupted track and the second track b is an interrupted track, i.e. the overlap area forms a gap in the second track. However, it is also possible that printing is carried out on the first path in part of the overlap area and on the second path in a complementary part.

FIG. 1 makes it also possible to see that there is at least one further overlap area 6 of the two paths A and B. In this case, the path B includes a plurality of path sections or a long, curved section which crosses the path A many times.

Figure 2:
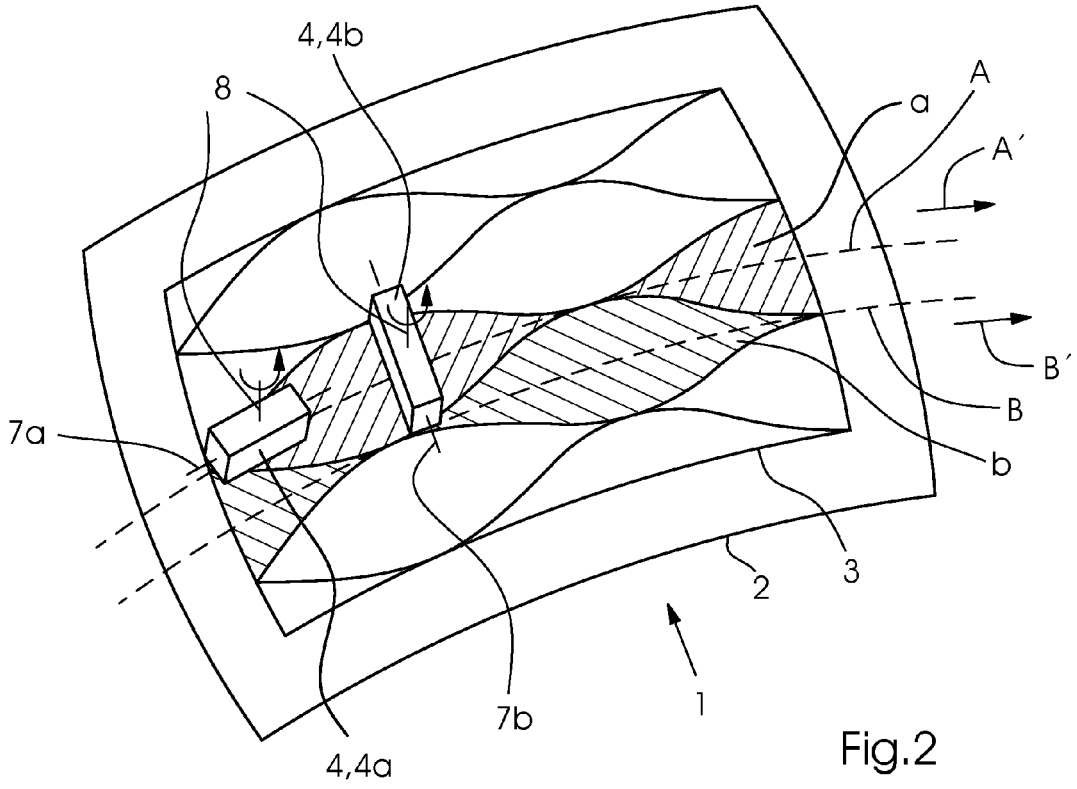
FIG. 2 is a diagrammatic, perspective view of a device during the performance of a further preferred embodiment of the method according to the invention.

FIG. 2 shows a diagrammatic perspective illustration of a device during the performance of a further preferred embodiment of the method according to the invention.

In FIG. 2, the inkjet head 4 is once more shown in two positions, once as an inkjet head 4*a* and once as an inkjet head 4*b*. The head 4*a* is substantially parallel to the direction A' of the first path A in its first orientation 7*a* and is substantially perpendicular to the direction A' in its second orientation 7*b*. The change in the orientation is effected by a rotation of the head 4 about its axis 8 during the forward movement, preferably by using the robot. The respective orientation 7*a* and 7*b* of the head in this case is parallel to the row of nozzles of the head. The head prints the first track a during the forward movement. An appropriately adapted rotation of the head is also carried out on an adjacent second path B, on which the second track b is printed. The adaptation of the rotations (through a control system) is carried out in this case in such a way that the two tracks a and b vary in their respective width in the forward direction and their edges adjoin one another without any gaps. In the example shown, the edges exhibit a snake-like course. During the rotation of the head, the image data activation of the same has to be varied in such a way that, despite the rotation and the speeds and accelerations of the individual nozzles resulting therefrom, a high-quality printed result is achieved.

The invention claimed is:

1. A method for printing at least one section of a curved surface of an object, the method comprising the following steps:

providing an inkjet head having a row of nozzles expelling ink;

providing an articulated-arm robot for moving the inkjet head;

carrying out a relative movement between the inkjet head and the curved surface of the object to move the inkjet head along a first path while printing a first track and to subsequently move the inkjet head along a second path while printing a second track, at least one of the first track or the second track having a curve; and causing a first track edge of the first track and a second track edge of the second track to intersect at a point and to enclose an angle between about 1° and about 179° at the point.

2. The method according to claim 1, wherein the angle lies between about 20° and about 70°.

3. The method according to claim 1, wherein the angle lies between about 110° and about 160°.

4. The method according to claim 1, wherein the angle lies at about 45°.

5. The method according to claim 1, wherein the angle lies at about 135°.

6. The method according to claim 1, wherein the first path and the second path overlap in an overlap area.

7. The method according to claim 6, wherein the inkjet head prints only on the first path or on the second path in at least part of the overlap area.

8. The method according to claim 6, wherein the inkjet head prints on the first path and does not print on the second path in the whole of the overlap area.

9. The method according to claim 7, wherein the second path crosses the first path in the overlap area.

10. The method according to claim 8, wherein the second path crosses the first path in the overlap area.

11. The method according to claim 9, wherein the second path and the first path cross in a plurality of overlap areas.

12. The method according to claim 10, wherein the second path and the first path cross in a plurality of overlap areas.

13. The method according to claim 11, wherein the at least one section of the surface of the object is assembled substantially from overlap areas.

14. The method according to claim 12, wherein the at least one section of the surface of the object is assembled substantially from overlap areas.

15. The method according to claim 1, which further comprises changing an orientation of the inkjet head relative to a respective one of the paths while the inkjet head is on at least one of the paths.

16. A method for printing at least one section of a curved surface of an object, the method comprising the following steps:

providing an inkjet head having a row of nozzles expelling ink;

providing an articulated-arm robot for moving the inkjet head;

moving the inkjet head along a first path while printing a first track on the curved surface of the object;

subsequently moving the inkjet head along a second path while printing a second track on the curved surface of the object;

providing at least one of the first track or the second track with a curve; and changing an orientation of the inkjet head relative to a respective one of the paths while the inkjet head is on at least one of the paths.

17. The method according to claim 16, which further comprises rotating the inkjet head about an axis during a forward movement of the inkjet head on at least one of the paths.

18. The method according to claim 17, wherein the axis is perpendicular to an area of at least one of the tracks.

* * * * *